US009714501B2

(12) United States Patent
Keiter et al.

(10) Patent No.: US 9,714,501 B2
(45) Date of Patent: Jul. 25, 2017

(54) PLUMBING FIXTURE WITH ELECTRIC SENSOR

(71) Applicant: Grohe AG, Hemer (DE)

(72) Inventors: Hans Dieter Keiter, Menden (DE); Achim Mielke, Porta Westfalica (DE); Frank-Thomas Luig, Menden (DE); Gunter Gaebel, Menden (DE)

(73) Assignee: Grohe AG, Hemer (DE)

( * ) Notice: Subject to any disclaimer, the term of this patent is extended or adjusted under 35 U.S.C. 154(b) by 89 days.

(21) Appl. No.: 14/201,207

(22) Filed: Mar. 7, 2014

(65) Prior Publication Data

US 2014/0250590 A1 Sep. 11, 2014

(30) Foreign Application Priority Data

Mar. 7, 2013 (DE) ..... 10 2013 003 824

(51) Int. Cl.
*E03C 1/04* (2006.01)
*E03C 1/05* (2006.01)

(52) U.S. Cl.
CPC ..... *E03C 1/0404* (2013.01); *E03C 1/055* (2013.01)

(58) Field of Classification Search
CPC ..... E03C 1/0404; E03C 1/055
USPC ..... 4/678
See application file for complete search history.

(56) References Cited

U.S. PATENT DOCUMENTS 8,555,427 B2 * 10/2013 Stauber ..... A47K 13/10 4/236
8,844,564 B2 * 9/2014 Jonte ..... E03C 1/05 137/551
2014/0338118 A1 * 11/2014 Davidson ..... E03C 1/055 4/623

FOREIGN PATENT DOCUMENTS

DE EP 0117504 A2 * 9/1984 ..... E03C 1/0404

OTHER PUBLICATIONS

EP 0 117 504 A2 English machine translation dated Jan. 9, 2015.*

* cited by examiner

*Primary Examiner* — Christine Skubinna
(74) *Attorney, Agent, or Firm* — Muncy, Geissler, Olds & Lowe, P.C.

(57) ABSTRACT

A plumbing fixture at least having a first housing section and a second housing section which are arranged movable to one another, whereby the first housing section together with the second housing section forms an electrical sensor. In particular, an electrically conductive and simultaneously sealing coupling component is provided between the housing sections, whereby further an electrically conductive coupling component is provided between the first housing section and the second housing section and the coupling component comprises an electrically conductive plastic.

12 Claims, 4 Drawing Sheets

PLUMBING FIXTURE WITH ELECTRIC SENSOR

This nonprovisional application claims priority under 35 U.S.C. §119(a) to German Patent Application No. DE 10 2013 003 824.3, which was filed in Germany on Mar. 7, 2013, and which is herein incorporated by reference.

BACKGROUND OF THE INVENTION

Field of the Invention

The present invention relates to a plumbing fixture that is sensitive at least partially to touch. The invention relates in particular to a plumbing fixture that has a proximity sensor and/or a touch sensor, preferably designed as a capacitive sensor.

Description of the Background Art

Plumbing fixtures are known whose activation or deactivation does not require the operation of a specific lever, but which when an area of the plumbing fixture housing is touched allow water to flow out or to again turn off water that is already flowing. To this end, the user in particular is given the opportunity to make water flow out by touching a housing part with the back of the hands, the wrist, or forearm. This has the advantage particularly that the fixture itself can be kept clean and optionally germ-free; in particular contact of the plumbing fixture with dirty hands is avoided.

It is provided in particular that when a predetermined area of the housing is touched or approached, water with a preset water volume and temperature is dispensed. In addition, operating elements can be provided with which then an optionally adjusted flow rate or a different temperature can subsequently be set. It is known for realizing this function to form an area of the housing in the manner of a capacitive touch sensor. Preferably, in this case, the faucet is formed at least partially as a capacitive sensor. When this housing section is touched, the electrical resistance is changed, which can be read by a suitable control unit. Said control unit can then activate or deactivate at least one valve of the water supply.

Because the sensitive area is to be easily accessible for the user of the plumbing fixture, one section of the faucet has proven preferable here. It is problematic, however, that this housing section in particular in many cases is made movable, so that an electrical connection between this sensitive housing section and the control unit and/or the electrical ground must be made beyond the movement limits.

Especially high requirements for movability, durability, and/or corrosion resistance must be imposed on this electrical connection. The solutions possibly known for this are associated either with a high number of parts, complicated assembly, and/or a problematic measurement-based evaluation.

SUMMARY OF THE INVENTION

On this basis, it is an object of the present invention to solve the problems described with respect to the state of the art at least in part. In particular, a plumbing fixture is to be provided which realizes in a technically simple manner such an electrical connection between plumbing fixture parts that are moved relative to one another. At the same time, the plumbing fixture is to be especially durable and convenient to operate.

It should be pointed out that the individually stated features in the claims can be combined in any technologically reasonable manner and demonstrate further embodiments of the invention.

The plumbing fixture has at least one first housing section and a second housing section which are arranged movable to one another, whereby the first housing section together with the second housing section forms an electrical sensor. Furthermore, an electrically conductive coupling component is provided between the first housing section and the second housing section. The coupling component in this case comprises an electrically conductive plastic.

The plumbing fixture is in particular a base (a housing section) to be mounted fixedly on a vanity and a faucet (a housing section) disposed movably, particularly rotatably and/or pivotably, thereto. In particular, both housing sections are provided to surround part of the water conduit up to the outlet opening. It is possible for this purpose that at least one housing section forms an (electrically) isolated rigid water line, but it is also possible that at least one of the housing sections houses a flexible water line, particularly a hose.

Whereas thus far particularly the concept has been pursued that only a single part of the housing is formed as a sensitive surface, it is now proposed here that the two parts, movable against one another, together form a (single) sensor, particularly in the manner of a capacitive sensor. In other words, this means in particular that both housing sections are at the same electrical potential. In particular, it can thus be avoided that the electrical contact of the movable housing sections is placed in the interior of the housing section and is then run further into the other housing section, for example, by means of a cable. Similarly, internal, complex, and interference-susceptible sliding contacts can be avoided. In particular, the invention is based on the concept that the electrical contacting goes directly/indirectly from one housing section to the other, and then can be taken up by the other housing section. This is preferably the fixed part, so that problems no longer arise here during the electrical contacting and conduction of the electrical signal.

In this regard, it is provided further that an electrically conductive coupling component is provided between the first housing section and the second housing section. The electrically conductive coupling component is particularly in contact both with the first housing section and with the second housing section in an electrically conductive manner. The coupling component accordingly can be located externally, internally, and/or between the housing sections. Basically it is also possible that certain areas of the coupling component are electrically isolated in order to possibly avoid contact with adjacent parts here. The coupling component is preferably designed so that in the connecting section it functions equally around the housing, therefore realizes the same effect over the entire extent of the housing section as to electrical contact.

It is preferred in such a coupling component that it forms an internal guide sleeve for the at least first housing section or the second housing section. Hereby, it is particularly assumed that both housing sections form a type of pipe connection in the area of the connecting section.

The coupling component here particularly is designed so that it can be inserted into the first housing section and/or the second housing section and has a shape so that these inserted areas form a guide sleeve lying internally against the first housing section and/or the second housing section. It is preferable that the coupling component forms a guide sleeve equally for the first housing section and the second housing section, so that particularly an axial orientation of both housing sections to one another is provided via the coupling component. This has advantages particularly for the durability and/or the assembly of the plumbing fixture.

Moreover, it is also provided that the coupling part comprises an electrically conductive plastic. It is basically possible in this respect that the coupling component has an electrically conductive coating and/or at least one electrically conductive conducting element and/or a uniformly electrically conductive structure. This makes it possible to design the coupling component with separate, different functional areas. It is likewise possible, however, to realize a multifunctional component with a uniform structure for the plastic part. An electrically conductive coating is preferably provided on the (outer) places where the adjacent parts, particularly the adjacent housing section, do not move relative to the coupling component. The conducting elements can be made in the manner of webs, printed traces, or the like. The plastic is preferably made with a thermoplastic. PP-EL (electrically conductive polypropylene) is cited here as an example of an electrically conductive plastic with a uniform structure. This material is provided especially with electrically conductive particles, which are arranged distributed in the plastic.

It is also proposed further that the coupling component bridges a gap between the first housing section and the second housing section in the direction of a central axis. The coupling component thereby bridges, for example, a gap between the two housing sections or the coupling component separates the first housing section from the second housing section. In particular, the area of the coupling component, which is disposed in this gap, touches both housing sections in the axial direction.

It is very especially preferred that the coupling component at the same time forms an internal guide sleeve and moreover extends into the gap between the first housing section and the second housing section.

Moreover, it is regarded as advantageous that the coupling component forms a seal between the first housing section and the second housing section. This prevents especially that moisture can pass over into the housing sections or out of the housing sections. Further, said seal can fulfill the function of minimizing or totally eliminating potential noise generation during the relative movement of both housing sections to one another.

It is furthermore regarded as advantageous that an electrically decoupled operating lever is provided on the first housing section or on the second housing section. The operating lever works particularly together with a mixing faucet and in this respect permits the regulation of the water flow and/or the water temperature. The operating lever is particularly fixed only to one of the two housing sections, whereby the operating lever itself is electrically decoupled from the sensitive surface of the housing sections. In particular, touching the operating lever does not result in a sensitive deactivation/activation of the water flow, like a contact in the area of the housing sections.

It is preferred further that the electrical sensor is a capacitive proximity sensor or capacitive touch sensor. Particularly in case that the housing sections are made as capacitive touch sensors, it is preferable that the electrical resistance of the coupling component is less than 30,000 ohm [30 kΩ], particularly less than 10,000 ohm [10 kΩ]. It is especially preferred that the entire outer surface of the first housing section and of the second housing section (and optionally of the coupling component) represents an electrode of the capacitive touch sensor.

It is also regarded as advantageous here that a control unit is provided, which works together with the electrical sensor and can activate or deactivate at least one valve of a water conduit. This is preferably an electrical valve, which depending on the evaluation by the electrical sensor opens or closes the water conduit by means of the control unit. In this regard, preferably at least one memory element, which can archive the state of the valve and/or a mixing cartridge in order to use the same settings again in a new activation, is provided in the control unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
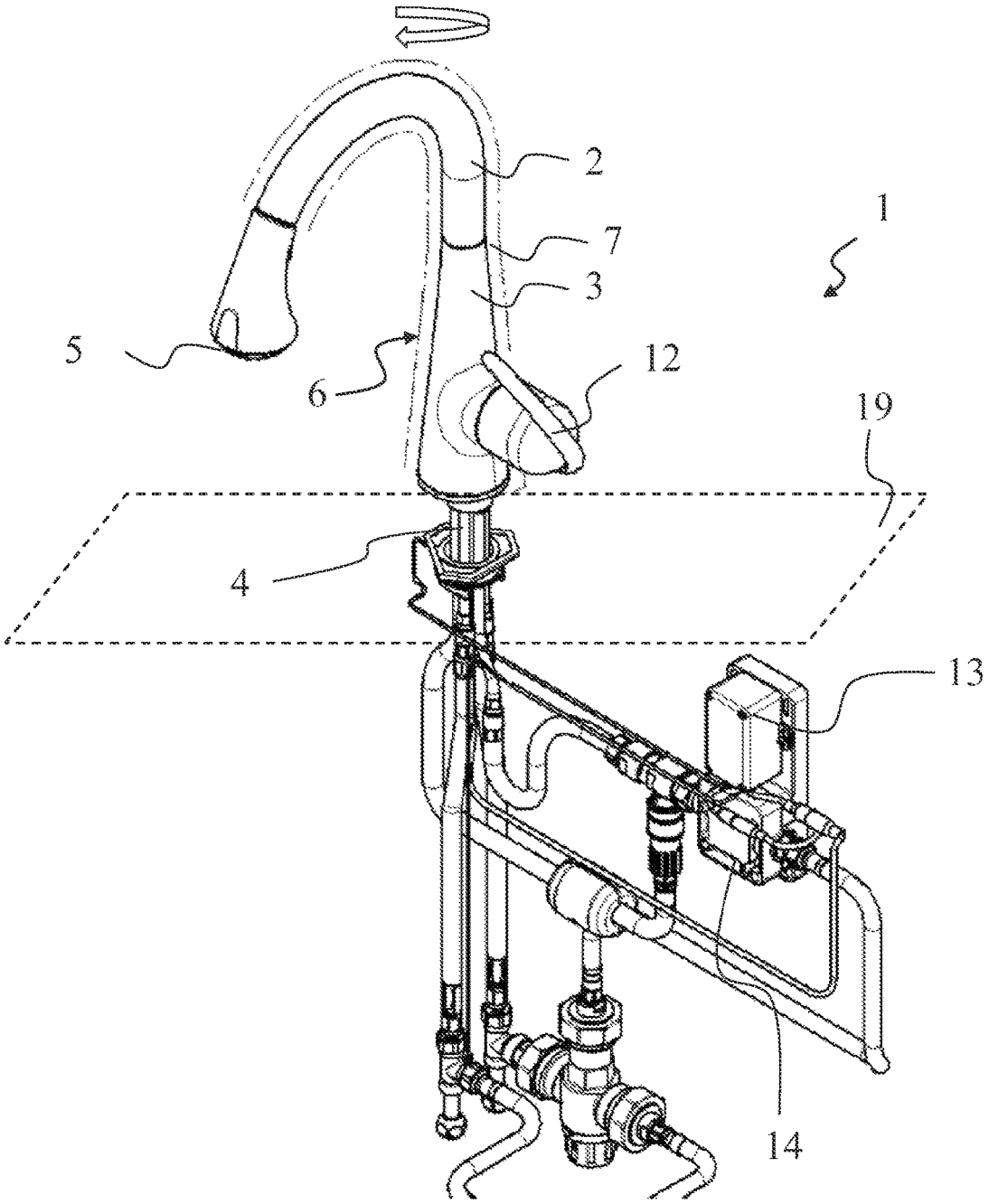
FIG. 1 shows a structure of an embodiment of the plumbing fixture.

FIG. 1 shows schematically and partially perspectively an installed plumbing fixture 1, which is mounted here, for example, on a vanity 19. First housing section 2 and second housing section 3 between which a coupling component 7 is disposed are positioned above vanity 19. In the embodiment shown here, first housing section 2 and second housing section 3 form a kind of faucet, whereby an outlet opening 5 for water is also arranged near first housing section 2. It is basically possible here that outlet opening 5 is connected fixedly to first housing section 2, but it is also possible that outlet opening 5 is formed with a spray plate of a hose, whereby outlet opening 5 and hose are then arranged electrically isolated from first housing section 2. An operating lever 12 is formed protruding on the side of second housing section 3. It is attached electrically isolated relative to second housing section 3.

As indicated by the arrow, first housing section 2 can be turned relative to second housing section 3. Both first housing section 2 and second housing section 3 are similarly sensitive to touch and therefore form a mutual (single) electrical sensor 6, as is illustrated particularly also by the dash-dot-dash line in FIG. 1.

Water conduit 4 in particular is accommodated in housing sections 2, 3. The necessary water connections, valves, and a control unit 13 are provided below vanity 19. Control unit 13 is especially in electrical contact with first housing section 2 and second housing section 3. In particular, control unit 13 detects when the electrical field changes because first housing section 2 or second housing section 3 was touched and accordingly switches an electric valve 14 with the result that the water flow is either started or stopped.

Figure 2:
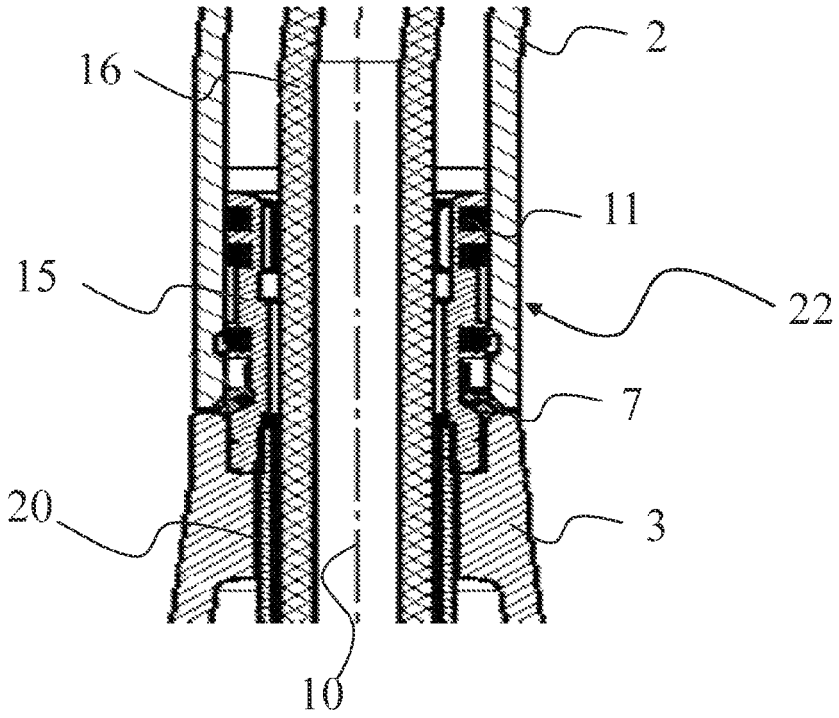
FIG. 2 shows a detail of a further alternative embodiment of the plumbing fixture in the area of a coupling component.

FIG. 2 shows in a sectional view a first alternative embodiment of the plumbing fixture in the area of the transition from first housing section 2 to second housing section 3. The two housing sections, which are formed here in the manner of pipe connections, form a substantially aligned outer surface 22 and are oriented to one another in terms of the face side or axially (in the direction of central axis 10). In this regard, first housing section 2 and second housing section 3 are in electrical contact with one another. An electrical coupling component 7, which reliably realizes an electrical contact between first housing section 2 and second housing section 3, is provided in the boundary area and internally near both housing sections 2, 3. It is basically possible that the electrical contact is realized directly also between both housing sections. Electrical coupling component 7 can hereby support or also assure the electrical contact, if a mechanical contact between the housing parts themselves no (longer) exists.

In the interior of the housing sections then, for example, an electrical insulation 15 is provided, which optionally also has a holding and/or alignment function in regard to at least one of the two housing sections. Electrical insulation 15 applies particularly to the interior parts, such as here, for example, the water conduit 4 formed as hose 16. Suitable seals 11 can be provided here also between the insulation and the housing sections. A collector 20 (e.g., made of brass), nevertheless, is in contact with second housing section 3 and forms a potential equalization.

Figure 3:
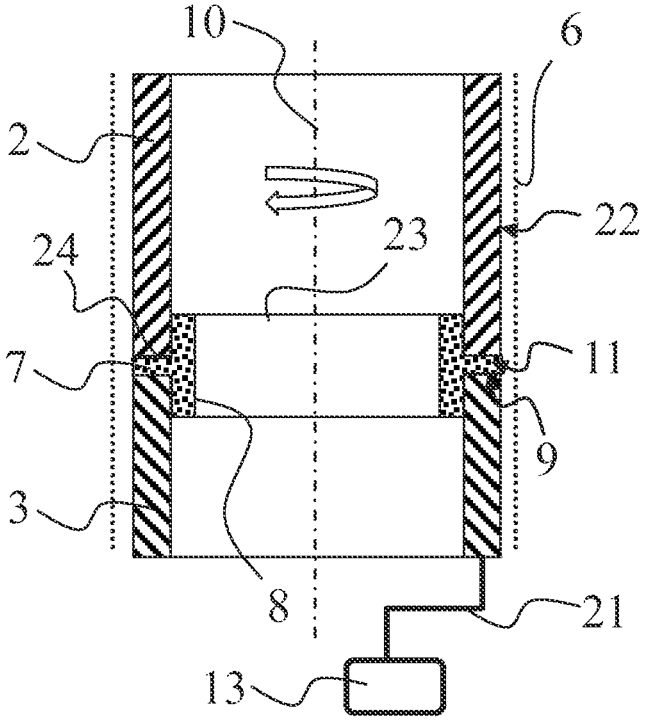
FIG. 3 shows a detail of a further alternative embodiment in the area of a coupling component.

A further alternative embodiment is illustrated in FIG. 3, whereby in particular the internal component groups of both housing sections 2, 3 are not elaborated in greater detail here. A special embodiment of electrical coupling component 7 is shown. It is made substantially in the manner of a sleeve 23, with a circumferential, centrally arranged collar 24. The areas extending in the direction of central axis 10 form in particular a guide sleeve 8, which because of internal contact with first housing section 2 and second housing section 3 enables an orientation of both of these parts to each other and, moreover, realizes a reliable contact to both housing sections. Collar 24 of coupling component 7 extends into a gap 9 between first housing section 2 and second housing section 3, so that coupling component 7 separates the two housing sections also axially relative to one another. The internal contact of coupling component 7 in the area of gap 9 moreover provides that a circumferential seal 11 is formed simultaneously. Outer surface 22 of housing sections 2, 3 and of coupling component 7 again form a mutual electrical sensor 6, particularly a capacitive touch sensor. The electrical signal can be easily passed on here, for example, at the fixed second housing section 3 via an electrical line 21 of control unit 13.

Coupling component 7 is preferably made as a single piece, whereby it is made preferably with an electrically conductive plastic.

Figure 4:
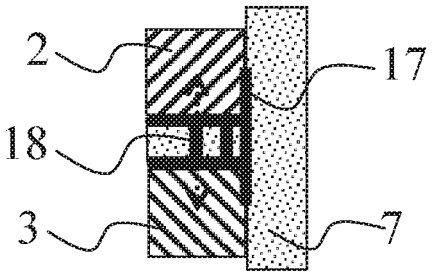
FIG. 4 shows a detail of a coupling component.

FIG. 3 and FIG. 4 show possible embodiments of coupling component 7, whereby the area between or in the immediate environment of the connecting section between first housing section 2 and second housing section 3 is illustrated in detail here.

In FIG. 4 coupling component 7 is made, for example, with plastic, whereby in predetermined areas it is formed with an electrically conductive coating 17 and/or electrical conducting elements 18. Whereas a coating 17 is provided only on the surface of coupling component 7, the electrical conductive elements 18 penetrate at least partially the base material of coupling component 7 and thus permit passing of a current through areas of coupling component 7.

Figure 5:
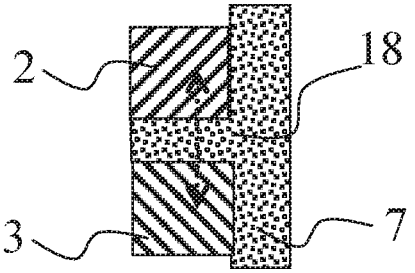
FIG. 5 shows a further detail of a further embodiment of the coupling component.

In contrast, FIG. 5 illustrates an alternative embodiment of a coupling component 7, in which electrical conductive elements 18 are distributed uniformly in the material (e.g., in the manner of granules), so that a homogeneous structure is achieved. For this purpose, particularly suitably conductive fibers, particles, or the like can be provided, which are in electrical contact with one another and thus can also realize transmission of current (directional and/or non-directional).

The plumbing fixture proposed here thus attains the aforementioned objects in a technically simple and effective manner.

As a precaution, in conclusion it should also be pointed out that the combinations of technical features as shown in the figures are not obligatory in general. Thus, the technical features of a figure can be combined with other technical features of another figure and/or the general description. Something different should apply only if the combination of features was shown explicitly here and/or the person skilled in the art realizes that otherwise the basic functions of the device can no longer be fulfilled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plumbing fixture comprising:

a first housing section;

a second housing section that is arranged to be movable with respect to the first housing section, the first housing section together with the second housing section forming an electrical sensor;

an electrically conductive coupling component provided between the first housing section and the second housing section, the coupling component formed of an electrically conductive plastic, wherein a portion of the coupling component forms part of an outer surface of the plumbing fixture, and wherein the portion of the coupling component forming part of the outer surface of the plumbing fixture is formed of the electrically conductive plastic.

2. The plumbing fixture according to claim 1, wherein the coupling component forms an internal guide sleeve for at least the first housing section or the second housing section.

3. The plumbing fixture according to claim 1, wherein the coupling component bridges a gap between the first housing section and the second housing section in the direction of a central axis.

4. The plumbing fixture according to claim 1, wherein the coupling component forms a seal between the first housing section and the second housing section.

5. The plumbing fixture according to claim 1, wherein an electrically decoupled operating lever is provided on the first housing section or on the second housing section.

6. The plumbing fixture according to claim 1, wherein the electrical sensor is a capacitive proximity sensor or capacitive touch sensor.

7. The plumbing fixture according to claim 1, wherein a control unit is provided, which works together with the electrical sensor and activates or deactivate at least one valve of a water conduit.

8. The plumbing fixture according to claim 3, wherein the coupling component includes a cylindrical sleeve portion and a flange that protrudes axially from an outer surface of the sleeve portion.

9. The plumbing fixture according to claim 8, wherein the flange is positioned in the gap between the first housing section and the second housing section, such that a distal end of the flange is the portion of the coupling component that forms part of the outer surface of the plumbing fixture.

10. The plumbing fixture according to claim 9, wherein an electrically conductive coating is provided on outer surfaces of the flange of the coupling component.

11. A plumbing fixture comprising:

a first housing section;

a second housing section that is arranged to be movable with respect to the first housing section, the first housing section together with the second housing section forming an electrical sensor;

an electrically conductive coupling component provided between the first housing section and the second housing section, the coupling component having an electrically conductive plastic, wherein a portion of the coupling component forms part of an outer surface of the plumbing fixture, wherein the coupling component bridges a gap between the first housing section and the second housing section in the direction of a central axis, wherein the coupling component includes a cylindrical sleeve portion and a flange that protrudes axially from an outer surface of the sleeve portion, and wherein the coupling component includes at least one electrically conductive element that penetrates through the flange of the coupling component in a direction parallel to the direction of a central axis of the plumbing fixture.

12. The plumbing fixture according to claim 1, wherein the coupling component includes electrically conductive particles uniformly distributed therein.

* * * * *